United States Patent [19]

Nakamura et al.

[11] Patent Number: 4,789,412

[45] Date of Patent: Dec. 6, 1988

[54] COBALT-BASE ALLOY HAVING HIGH STRENGTH AND HIGH TOUGHNESS, PRODUCTION PROCESS OF THE SAME, AND GAS TURBINE NOZZLE

[75] Inventors: Shigeyoshi Nakamura, Katsuta; Tetsuo Kashimura, Hitachi; Nobuyuki Iizuka, Hitachi; Yutaka Fukui, Hitachi; Minoru Morikawa, Katsuta; Soichi Kurosawa, Hitachi, all of Japan

[73] Assignee: Hitachi, Ltd., Tokyo, Japan

[21] Appl. No.: 28,085

[22] Filed: Mar. 19, 1987

[30] Foreign Application Priority Data

Mar. 20, 1986 [JP] Japan ..... 61-60577

[51] Int. Cl.[4] ..... C22C 19/07

[52] U.S. Cl. ..... 148/408; 148/158; 148/3

[58] Field of Search ..... 420/439; 148/408, 425, 148/158, 3

[56] References Cited

U.S. PATENT DOCUMENTS 4,080,202 3/1978 Fukui et al. ..... 420/439

4,437,913 3/1984 Fukui et al. ..... 148/408

*Primary Examiner*—R. Dean

*Attorney, Agent, or Firm*—Antonelli, Terry & Wands

[57] ABSTRACT

A cobalt-base alloy comprises 0.2–1 wt % C 0.4–2 wt % Si, 0.2–1.5 wt % Mn, 5–15 wt % Ni, 20–35 wt % Cr, 3–15 wt % W, 0.003–0.1 wt % Ni, 20–35 wt % Cr, 3–15 wt % W, 0.003–0.1 wt % B, 0.05–1 wt % Nb, 0.01–1 wt % Ta, 2 wt % or less Fe, 30 ppm or less oxygen, 100 ppm or less nitrogen, and the balance of 45 wt % or more Co, wherein the content of Si is larger than that of Mn. The alloy is in a form of casting and has a structure containing a eutectic carbide and a secondary carbide dispersed therein. The cast alloy is produced through solution treatment at 1,100°–1.200° C., and aging treatment at 950°–1,050° C., and cooling rate after the solution treatment and after the aging treatment is 150° to 300° C./h. A gas turbine nozzle is made of a casting of the above-mentioned alloy.

11 Claims, 2 Drawing Sheets

COBALT-BASE ALLOY HAVING HIGH STRENGTH AND HIGH TOUGHNESS, PRODUCTION PROCESS OF THE SAME, AND GAS TURBINE NOZZLE

BACKGROUND OF THE INVENTION

1. Field of the Invention

This invention relates to a cobalt-base alloy having excellent high-temperature strength and high-temperature ductility and, more particularly, to a nozzle of a gas turbine, made of a casting of the cobalt-base alloy.

2. Description of the Prior Art

Conventionally, cobalt-base alloys have been used, e.g., for first-stage nozzles of a gas turbine which undergo rapid repetition of heating and cooling. The intended service life of the nozzles is 20,000 to 30,000 hr or longer at a temperature as high as 800° to 1,000° C. Such a cobalt-base superheat-resistant alloy has been produced by precision casting, and the development thereof has been directed mainly towards an improvement in a high-temperature strength, particularly an improvement in creep rupture strength. This unfavorably led to a disadvantage of the cobalt-base alloy that the high-temperature ductility is unsatisfactory. In fact, the examination on cracking caused in service revealed that the cracking was not attributable to a high-temperature strength but thermal fatigue due to repeated occurrence of thermal stress. Conventional cobalt-base alloys have a sufficient creep rupture strength as well as a creep rupture ductility enough to be put into practical use up to 900 ° C. However, the ductility lowers rapidly at a temperature exceeding 900° C., e.g., 982° C. Particularly, the results of a long-term creep rupture test over 1,000 hr or longer showed that the elongation was remarkably lowered and as low as several %. This suggests that, when a gas turbine is used at a temperature of 900° C. or above, the thermal stress of the nozzle is a causative factor of occurrence of cracking. The material for the nozzle is required to have a combination of an excellent high temperature strength with an excellent high-temperature ductility.

The reason why conventional cobalt-base alloys are high in high-temperature ductility at a temperature of 900° C. or below but rapidly lowered when the temperature exceeds 900° C. is that cobalt in itself is generally low in oxidation resistance, which requires the presence of a high content of chromium, leading to formation of nonmetallic inclusions in the band form, which seem to be oxides, at grain boundaries during casting, which in turn makes grain boundary deformation difficult.

When the temperature is 900° C. or below, the ductility of the alloy is high, because the ductility of the matrix is high due to formation of a small amount of precipitates and, at the same time, the extent of the influence of the nonmetallic inclusions on the grain boundaries is small. On the other hand, when the temperature is 982° C. or above, carbides precipitate in the matrix to strengthen the latter, thus making it difficult to deform the matrix, which gives an influence on the grain boundaries.

When the amount of chromium is large, nitrides precipitate at a high temperature, e.g., 982° C., which is a causative factor of lowering in the ductility of an alloy. Further, a cobalt-base alloy having a high content of chromium brings about a grain boundary oxidation at a high temperature, leading to lowering in ductility. In a high strength cobalt-base alloy, a solid-solution strengthening element (e.g., tungsten or molybdenum) and carbon are added to form a carbide, which strengthen the cobalt-base alloy. Such a carbide is often formed in a net-like shape. The carbide is selectively oxidized at a high temperature with ease. Therefore, when the oxidation atthe grain boundaries proceed, the resulting oxide brings about a stress concentration with respect to a tensile stress, which leads to lowering in strength and ductility.

SUMMARY OF THE INVENTION

OBJECT OF THE INVENTION

A conventional cobalt-base alloy to which carbide-forming elements such as titanium, zirconium, tungsten, molybdenum, niobium or tantalum have been added in order to improve the high-temperature strength is disclosed in U.S. Pat. Nos. 4,437,913 and 4,080,202. The present inventors have found that the addition of these alloy elements could contribute to an improvement in high-temperature strength as well as high temperature ductility but led to problems related to production and oxidation resistance, because, as mentioned above, a gas turbine nozzle is produced by precision casting and has a portion having a wall thickness as small as 1 mm or less.

In recent years, a high-efficiency gas turbine of which the inlet gas temperature is 1,300° to 1,600° C. is under development. The nozzle material for this gas turbine is required to have a rupture strength of 4.3 kg/mm$^2$ or more as determined at 982° C. for 1,000 hr and a contraction ratio of 20% or more as determined at 982° C. for 100 hr.

An object of the present invention is to provide a cobalt-base alloy which not only exhibits excellent high temperature strength and high-temperature toughness, particularly excellent high-temperature strength and high temperature toughness at 982° C. or above, but also has an excellent castability.

STATEMENT OF THE INVENTION

The present invention consists in a casting of a cobalt-base alloy having a high strength and a high toughness and comprising 0.2 to 1% by weight of carbon, 0.4 to 2% by weight of silicon, 0.2 to 1.5% by weight of manganese, 5 to 15% by weight of nickel, 20 to 35% by weight of chromium, 3 to 15% by weight of tungsten, 0.003 to 0.1% by weight of boron, 0.05 to 1% by weight of niobium and 0.01 to 1% by weight of titanium, and optionally 0.02 to 1% by weight of zirconium, and 30 ppm or lower of oxygen and 100 ppm or lower of nitrogen with the balance being 40% by weight or more of cobalt and unavoidable impurities, the casting containing silicon in an amount larger than that of manganese and having a structure containing a eutectic carbide.

Further, the present invention consists in an alloy of the kind as mentioned above which further contains at least one member selected from the group consisting of 0.01 to 0.5% by weight of rare earth elements and 0.01 to 0.5% by weight of yttrium.

A preferred alloy comprises 0.35 to 0.45% by weight of carbon, 0.4 to 1.00% by weight of silicon, 0.2 to 0.6% by weight of manganese, 9.5 to 11.5% by weight of nickel, 28.5 to 30.5% by weight of chromium, 6.5 to 7.5% by weight of tungsten, 0.005 to 0.015% by weight of boron, 0.1 to 0.3% by weight of titanium and 0.15 to 0.35% by weight of niobium, and optionally 0.1 to 0.3% by weight of zirconium, and 25 ppm or lower of oxygen and 30 ppm or lower of nitrogen with the balance being cobalt, wherein the silicon/manganese weight ratio is 1.3 to 2.5, and another preferred alloy comprises a composition of the kind as mentioned just above which further contains at least one member selected from the group consisting of 0.03 to 0.15% by weight of rare earth elements and 0.03 to 0.15% by weight of yttrium.

The alloy of the present invention is characterized by possessing a structure having a eutectic carbide and a secondary carbide dispersed therein which has been formed by the solution heat treatment followed by aging.

The alloy of the present invention is excellent in high temperature strength and resistance to fatigue caused by thermal stress due to repeated temperature fluctuation, particularly exhibits an excellent high-temperature ductility even at 982° C.

The present invention will now be described in more detail.

Carbon content: 0.2 to 1% by weight

The presence of carbon is essential in enhancing the strength of the alloy. However, the content lower than 0.2% by weight as well as the content exceeding 1% leads to an unsatisfactory strength. Further, when the content exceeds 2% by weight, there occurs aggregation of carbides, leading to lowering in ductility.

A preferred content of carbon is 0.25 to 0.8% by weight. A particularly preferred content is 0.35 to 0.45% by weight in view of a combination thereof with the contents of titanium, niobium and zirconium.

Silicon content: 0.4 to 2% by weight

Although silicon is generally added as a deoxidizer, it also contributes to an improvement in oxidation resistance and fluidity. In order to attain a sufficient fluidity and deoxidation effects, it is necessary to add silicon in an amount of 0.4% or more. Since inclusions tend to be left during casting when the content exceeds 2%, it is necessary that the silicon content be 2% by weight or less. A particularly preferred silicon content is 0.4 to 1% by weight.

Tungsten content: 3 to 15% by weight

Tungsten is added in an amount of 3% by weight or more in order to improve the high-temperature strength. Since the oxidation resistance is lowered when the tungsten content exceeds 15%, it is required that the tungsten content is in the range of 3 to 15% by weight. A preferred tungsten content is in the range of 6.5 to 7.5% by weight.

Boron content: 0.003 to 0.1%

Boron is added to improve the high-temperature strength as well as high-temperature ductility. Little or no effect can be attained when the content is less than 0.003% by weight. On the other hand, the content exceeding 0.1% by weight brings about a problem related to weldability. Therefore, it is required that the tungsten content is in the range of 0.003 to 0.1% by weight. A preferred tungsten content is in the range of 0.005 to 0.015% by weight.

Zirconium content: 0.02 to 0.5% by weight; titanium content: 0.01 to 1% by weight; niobium content: 0.05 to 1% by weight The addition of a small amount of a combination of titanium with niobium or further addition of zirconium exhibits a more significant effect. These elements exhibit the best effects in combination with the contents of carbon, tungsten, boron, chromium and nickel as mentioned above or as will be mentioned below.

In general, zirconium, titanium and niobium are high in carbide-forming capacity and, therefore, added as elements for enhancing the precipitation of carbides in order to strengthen heat-resistant alloys. Although the cobalt-base alloy is used at a high temperature at which the enhancement of the precipitation of carbides cannot be expected, the present inventors have found that the addition of minute amounts of zirconium, titanium and niobium in combination has a delicate effect on the dispersion of a eutectic carbide and a secondary carbide, which contributes to a high strength and a high ductility. Intended high-temperature strength and high temperature ductility cannot be attained with a niobium content of less than 0.05% by weight, a titanium content of less than 0.01% by weight and a zirconium content of 0.02% by weight. The addition of minute amounts of these elements leads to formation of a eutectic carbide in a dispersed state and precipitation of a fine secondary carbide on aging as well as deoxidation and denitriding, which contributes to a remarkable improvement in creep rupture strength, elongation at rupture and contraction ratio.

However, the amounts of these elements exceeding certain extents, i.e., 1% by weight in the case of niobium, 1% by weight in the case of titanium and 0.5% by weight in the case of zirconium bring about formation of a huge carbide and large amounts of inclusions and increase in brittleness and deterioration in oxidation resistance in the case of niobium. Therefore, it is required that the contents of titanium and niobium and, if any, zirconium be in the ranges of 0.01 to 1% by weight, 0.05 to 1% by weight and 0.02 to 0.5% by weight, respectively. A particularly preferred combination comprises 0.1 to 0.3% by weight of titanium and 0.15 to 0.35% by weight of niobium and optionally 0.1 to 0.3% by weight of zirconium.

Contents of rare earth element and yttrium: 0.01 to 0.5% by weight

The rare earth element is high in deoxidizing power and desulfurizing power and effective particularly in improving the high-temperature ductility through an interaction with the above-mentioned elements, i.e., zirconium, titanium and niobium. The rare earth element is added in an amount of 0.01 to 1% by weight in melting an alloy. When atmospheric melting of the alloy is conducted, an amount of its addition of less than 0.01% brings about no significant effect, because this results in only a trace amount thereof incorporated in the alloy, i.e., the content thereof in the alloy is too small. On the other hand, an amount of its addition exceeding 0.5% by weight leads to formation of large amounts of inclusions in the case of atmospheric melting and leads to no further improvement as compared with the addition in an amount of 0.5% by weight or less in the case of vacuum melting. The proper selection of conditions of melting in a non-oxidizing atmosphere such as vacuum melting leads to the similar content thereof with only a less amount of addition thereof. Preferred rare earth elements include scandium and lanthanoids, and lanthanoids are particularly effective. In general, lanthanoids afford a mischmetal which is composed mainly of cerium and lanthanum. A commercially available mischmetal is composed of about 52% by weight of cerium, about 24% by weight of lanthanum, about 18% by weight of neodymium and about 5% by weight of praseodymium. Preferred amounts of these elements are in the range of 0.03 to 0.15%.

Since the addition of the rare earth element brings about mainly deoxidation, the vacuum melting does not always require the addition of the rare earth element. Since, however, the vacuum melting cannot bring about desulfurization in the absence of a rare earth element, it is preferred that the rare earth element be added in this case as well.

Manganese content: 0.2 to 1.5% by weight

In order to attain sufficient effects with respect to fluidity and a high-temperature strength, it is required that the content of manganese be 0.2% by weight or higher in consideration of the content of silicon. The content of manganese exceeding 1.5% leads to deterioration of oxidation resistance. A particularly preferred content of manganese is in the range of 0.2 to 0.6% by weight.

In producing a casting having a thin-wall portion, such as nozzles of a gas turbine, it is important that the content of silicon be higher than the value obtained by the following equation:

$$\text{Si (wt \%)} = 0.7 \times \text{Mn (wt \%)} + 0.48$$

Nickel content: 5 to 15% by weight

Nickel is added in an amount of 5% by weight or more to enhance the high-temperature strength. When the amount of its addition is increased largely, no corresponding improvement in strength can be attained. Therefore the content of nickel is 5 to 15% by weight, preferably in the range of 9.5 to 11.5% by weight.

Chromium content: 20 to 35% by weight

The content of chromium should be determined taking into consideration the content of titanium so that there is caused neither cold shot nor internal oxidation of carbides. In order to improve the oxidation resistance, it is required that the content of chromium be 20% or higher. However, the content of chromium exceeding 35% brings about not only lowering in high-temperature ductility due to formation of cold shot and internal oxidation of carbide caused in service, but also an increase in brittleness in service at a high temperature for a long period of time. A preferred content of chromium is in the range of 28.5 to 30.5% by weight.

Iron content: 2% by weight or lower

The addition of iron as a mother alloy when adding carbon, silicon, manganese, tungsten, niobium, titanium, zirconium, boron, etc. effectively enhances the yield of addition of these elements, but unfavorably lowers the high-temperature strength. Therefore, in order to maintain an excellent high temperature strength, it is necessary that the content of iron be 0.5% by weight or lower.

The cobalt-base alloy of the present invention is melted in vacuum and then cast in vacuum. Therefore, it is most important that the alloy be high in both strength and toughness (ductility) in the form of a casting. Since the alloy of the present invention is melted in vacuum and then cast in vacuum, it is preferred that the contents of gases be low. Specifically, the contents of nitrogen, oxygen, phosphorus and sulfur are preferably 100 ppm or lower, 30 ppm or lower, 0.02 ppm or lower and 0.01 ppm or lower, respectively. Particularly, it is preferred that the contents of nitrogen and oxygen be 35 ppm or lower and 25 ppm or lower, respectively.

As is apparent from the foregoing description, the present inventors have found that the addition of minute amounts of titanium and niobium and optionally zirconium in combination with the relationship with the silicon/manganese weight ratio and the above-mentioned amounts of gases leads to formation of carbides thereof which serve as a nucleus for formation of eutectic carbides as well as a nucleus for precipitation of secondary carbides accompanying the aging, thus giving fine carbides and contributing to significant improvements in strength and ductility.

Further, in the present invention, the relationship between the content of manganese and the total of the contents of titanium, niobium and zirconium is important. Specifically, manganese improves the fluidity while titanium, niobium and zirconium lowers the fluidity. The weight ratio of manganese to the total of titanium, niobium and zirconium is preferably in the range of 0.5 to 1.5. Such a range contributes to a high precision of a casting as well as a high strength and a high toughness of an alloy. Particularly, it is preferred from the above reason that the weight ratio of manganese to niobium be in the range of 1 to 3.

Further, in the present invention, the relationship between the content of silicon and that of niobium which lowers the oxidation resistance is also important. Since the oxidation resistance is increased as the content of silicon is increased, the weight ratio of silicon to niobium is preferably in the range of 2.5 to 5, particularly preferably in the range of 3 to 4, which leads to an alloy having an excellent high oxidation resistance and an excellent high-temperature strength.

Although Si and Mn, in a prior art alloy, are used as a deoxidizer when molten metal of the alloy is formed in vacuum, in the alloy of the present invention Si and Mn need not be used as the deoxidizer. However, management of casting molds with respect to lost wax, for example, is difficult. Therefore, it is necessary to improve the fluidity of the molten metal.

As mentioned above, it was found that inclusion of a larger amount of Si than that of Mn gets to have an excellent casting. In particular, amounts of oxygen and nitrogen can be lowered through the vacuum melting when amounts of Si and Mn to be added in the alloy of the present invention are determined according to the above-mentioned equation. The alloy thus formed exhibits an excellent fluidity of the molten metal.

The alloy of the present invention is applied particularly to a nozzle of a gas turbine which is in the form of a casting having a wall thickness as small as 1.5 mm or less. The nozzle is produced as follows.

A nozzle of a gas turbine produced by precision casting of molten metal formed by vacuum melting such as the lost wax process is slowly heated in a non-oxidizing atmosphere to 1,100° to 1,200° C. at a temperature elevation rate of 600° C./hr or less and then subjected to solution heat treatment by maintaining at that temperature for 2 to 10 hr. Subsequently, the nozzle is allowed to cool to a temperature for aging, i.e., 950° to 1050° C., by furnace cooling or leaving it to stand in air and then maintained at that temperature for 2 to 10 hr for aging. The temperature of the nozzle is lowered from the aging temperature to a temperature by 200° C. lower than the softening temperature of the alloy by furnace cooling. The nozzle is taken out of the furnace and allowed to cool at room temperature. The above-mentioned temperature control enables casting having a high precision with no significant strain and having a high strength and a high toughness. It is preferred that the above-mentioned heat treatments be conducted in a non-oxidizing atmosphere. Further, it is preferred that the rate of cooling from the temperature for solution heat treatment and the temperature for aging be in the range of 150° to 300° C./hr.

The vacuum melting is preferable to conduct at vacuum in the range of from 0.1 to $10^{-4}$ torr and, particularly preferably in the range of from $10^{-2}$ to $5\times10^{-3}$ torr.

DESCRIPTION OF THE EMBODIMENTS

Figure 1:
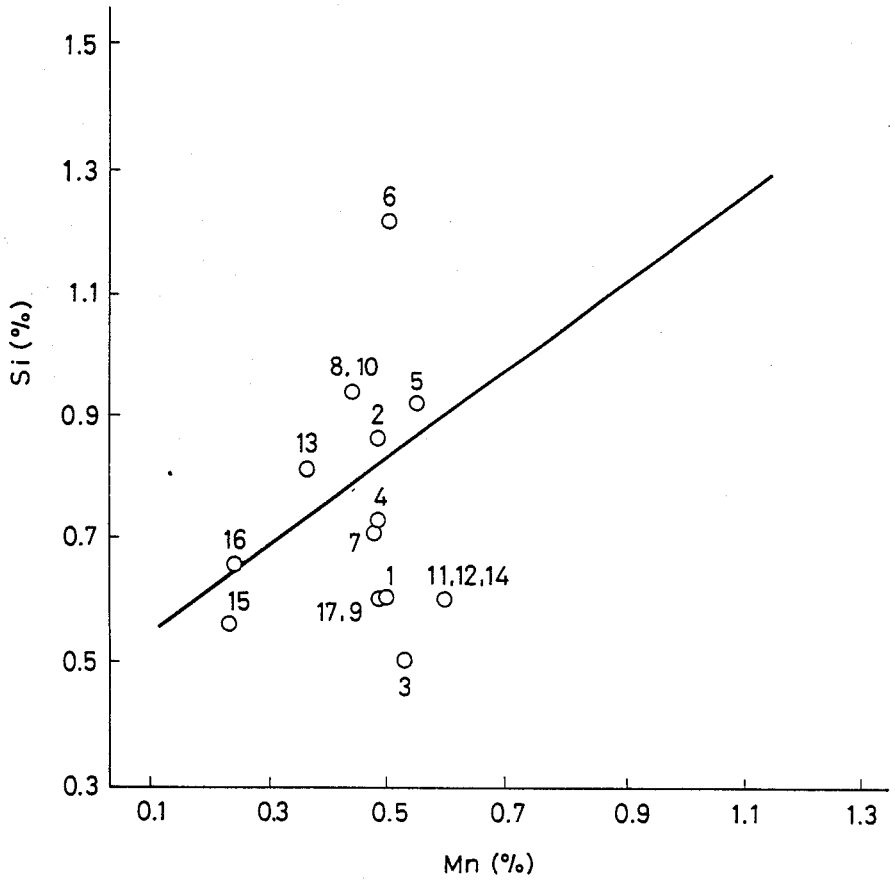
FIG. 1 is a graph showing the relationship between the content of silicon and that of manganese.

The chemical compositions (in terms of % by weight) of the sample alloys as used in the present embodiment are listed in the table given below. These alloys are in the form of castings having a dimension of 100 mm×200 mm×15 mm which are prepared by pouring a molten metal obtained through a high-frequency melting in a mold prepared by the lost wax process. Sample Nos. 1 to 16 are castings prepared by melt casting in a vacuum of $10^{-3}$ torr. Sample No. 17 which is a conventional alloy was prepared by blending carbon, nickel, chromium, tungsten, iron, boron and cobalt, melting the mixture in the air and adding silicon and manganese to the resulting molten metal. The alloys of sample Nos. 1 to 16 which contain niobium, titanium, zirconium, etc. added therein were prepared by blending carbon, nickel, chromium, tungsten, iron, boron and cobalt, melting the resulting mixture and adding silicon and manganese and then niobium, titanium and zirconium to the resulting molten metal. In this connection, it is noted that, in each of the alloys of sample Nos. 9 and 10, 0.3% by weight of a mischmetal was added after addition of silicon and manganese. The alloys to which the mischmetal had been added had a lanthanum content of about 0.02% by weight and a cerium content of about 0.08% by weight. Sample Nos. 2, 5, 6, 8, 10, 13 and 16 are the alloys of the present invention while sample Nos. 1, 3, 4, 7, 9, 11, 12, 14, 15 and 17 are comparative alloys. The alloys of the present invention and the comparative alloys (No. 1-16) each had 30 ppm or less of oxygen and 100 ppm or less of nitrogen. The alloys of the present invention had 25 ppm or less of oxygen and 30 ppm or less of nitrogen. Oxygen and nitrogen of the conventional alloy No. 17 were 250 ppm and 650 ppm, respectively. Each sample was heated at 1150° C. for 4 hr for solution heat treatment, cooled to 982° C. in the furnace, maintained at that temperature for 4 hr for aging, subjected to furnace cooling to 550° C. and then air cooled to room temperature. The samples thus treated were worked into creep rupture test specimens (diameter at its parallel portion: 6 mm; length: 30 mm), and the specimens were applied to tests. In each sample, the rate of cooling after heat treatment was 280° C./hr.

TABLE

| No. | C | Si | Mn | Cr | Ni | W | Nb | Ti | Zr | Fe |
|---|---|---|---|---|---|---|---|---|---|---|
| 1 | 0.30 | 0.60 | 0.50 | 29.8 | 10.5 | 7.02 | 0.20 | 0.21 | — | 2.3 |
| 2 | 0.31 | 0.85 | 0.49 | (30.0) | (10.5) | (7.0) | 0.25 | 0.18 | — | " |
| 3 | 0.40 | 0.50 | 0.53 | " | " | " | 0.28 | 0.15 | 0.12 | 1.8 |
| 4 | (0.4) | 0.72 | 0.49 | " | " | " | 0.26 | 0.16 | 0.16 | (1.8) |
| 5 | 0.38 | 0.91 | 0.56 | 28.94 | 10.26 | 7.08 | 0.26 | 0.12 | 0.16 | 0.08 |
| 6 | (0.4) | 1.21 | 0.52 | (30.0) | (10.5) | (7.0) | (0.25) | (0.15) | (0.15) | (1.8) |
| 7 | " | 0.70 | 0.48 | " | " | " | " | " | " | " |
| 8 | " | 0.93 | 0.45 | " | " | " | " | " | " | " |
| 9 | " | 0.60 | 0.49 | " | " | " | " | " | " | " |
| 10 | " | 0.93 | 0.45 | " | " | " | " | " | " | " |
| 11 | 0.29 | (0.6) | (0.6) | (29.5) | " | " | 0.24 | 0.15 | 0.15 | (4.0) |
| 12 | 0.36 | " | " | " | " | " | 0.24 | 0.15 | 0.19 | (3.0) |
| 13 | 0.38 | 0.81 | 0.37 | 29.2 | 10.95 | 7.11 | 0.21 | 0.13 | 0.30 | 1.9 |
| 14 | 0.94 | (0.6) | (0.6) | 29.5 | 10.5 | 7.0 | 0.24 | 0.15 | 0.23 | 1.5 |
| 15 | 0.38 | 0.55 | 0.23 | 29.1 | 10.3 | 7.1 | 0.24 | 0.19 | 0.21 | 1.8 |
| 16 | 0.37 | 0.65 | 0.24 | 29.0 | 10.4 | 7.0 | 0.13 | 0.12 | 0.16 | 1.75 |
| 17 | 0.28 | 0.60 | 0.49 | 30.75 | 11.0 | 7.02 | — | — | — | — |

| No. | B | Y | misch-metal | Co | strength (kgf/mm²) | contraction ratio (%) | Oxidation resistance (mg/cm²) |
|---|---|---|---|---|---|---|---|
| 1 | 0.010 | — | — | balance | 4.8 | 62 | 8.2 |
| 2 | (0.010) | — | — | " | 4.9 | 60 | 8.0 |
| 3 | " | — | — | " | 5.6 | 64 | 8.0 |
| 4 | " | — | — | " | 5.7 | 66 | 7.5 |
| 5 | 0.008 | — | — | " | 5.8 | 65 | 7.3* |
| 6 | (0.010) | — | — | " | 5.6 | 56 | 6.8 |
| 7 | " | (0.15) | — | " | 5.6 | 66 | 7.2 |
| 8 | " | " | — | " | 5.5 | 65 | 7.0 |
| 9 | " | " | (0.3) | " | 5.6 | 64 | 7.4 |
| 10 | " | " | " | " | 5.6 | 66 | 7.3 |
| 11 | 0.016 | — | — | " | 5.7 | 61 | 7.3 |
| 12 | (0.01) | — | — | " | 5.7 | 66 | 7.2 |
| 13 | 0.009 | — | — | " | 5.9 | 65 | 7.0 |
| 14 | 0.008 | — | — | " | 5.0 | 54 | 7.2 |
| 15 | 0.010 | — | — | " | 5.5 | 58 | 7.2 |
| 16 | 0.009 | — | — | " | 5.6 | 62 | 7.0 |
| 17 | 0.014 | — | — | " | 3.2 | 19 | 7.0 |

The results of tests with respect to creep rupture strength as determined at 982° C. for 1,000 hr, contraction ratio in creep rupture for 100 hr and increase in weight accompanying oxidation due to heating at 1,000° C. for 1,000 hr are shown in the table given below. As is apparent from the table, both the strength and contraction ratio of the alloys of the present invention are excellent as compared with those of the conventional alloys and 4.9 kg/mm² or higher and 56% or higher, respectively. Since the alloy of sample No. 6 contains silicon in a content of 1.2% by weight, i.e., slightly higher than the content in the other alloys, the contraction ratio of the alloy of sample No. 6 is lower than those of the other alloys of the present invention but is remarkably higher than that of a comparative alloy of sample No. 17. In order to obtain an alloy having a high contraction ratio, it is preferred that the content of silicon be 1% by weight or less.

FIG. 1 is a plot of the silicon content against the manganese content of the alloys as listed in the table. It was found that the alloys of sample Nos. 2, 5, 6, 8, 10, 13 and 16 according to the present invention, having a silicon content larger than the value as indicated with a solid line representing the silicon content in connection with the manganese content, exhibited a high fluidity in producing a casting having a thin-wall portion and provided castings having no significant casting defects. All the alloys of the present invention provided satisfactory castings while comparative alloys brought about slight defects. The solid line in FIG. 1 is represented by the following equation:

$$\text{Si (\% by weight)} = 0.7 \times \text{Mn (\% by weight)} + 0.48$$

The casting defects in precision casting is related to the contents of silicon and manganese as well, and it is required that the contents of silicon and manganese be 0.65% by weight or higher and 0.2% by weight or higher, respectively.

Further, it was confirmed that a strength of 5.0 $kg/mm^2$ or higher and a contraction ratio of 60% or higher could be attained when the contents of titanium, niobium and zirconium were 0.10 to 0.15% by weight, 0.20 to 0.25% by weight and 0.03 to 0.3% by weight, respectively. In these cases, the weight ratio of manganese to the total of titanium, niobium ad zirconium was in the range of 0.58 to 1.14, and satisfactory castings having no significant defects could be obtained. This ratio was 1.14 for sample No. 2, 1.06 for sample No. 5, 0.95 for sample No. 6, 0.82 for sample No. 8, 0.82 for sample No. 10, 0.58 for sample No. 13 and 0.59 for sample No. 16.

Further, in the alloys of the present invention, the weight ratio of silicon to niobium which shows the relationship between the contents of silicon and niobium were 3.4 for sample No. 2, 3.5 for sample No. 5, 4.84 for sample No. 6, 3.72 for sample No. 8, 3.72 for sample No. 10, 3.86 for sample No. 13 and 5.0 for sample No. 16, and all the alloys of these samples exhibited an excellent oxidation resistance. Specifically, as can be seen in the table, with respect to the oxidation resistance, the alloy of the present invention of sample No. 2 was more excellent than the comparative alloy of sample No. 1, the alloys of the present invention of sample Nos. 5 and 6 were more excellent than the comparative alloys of sample Nos. 3 and 4, the alloy of the present invention of sample No. 8 was more excellent than the comparative alloy of sample No. 7, the alloy of the present invention of sample No. 10 was more excellent than the comparative alloy of sample No. 9, the alloy of the present invention of sample No. 13 was more excellent than the comparative alloy of sample No. 12 and the alloy of the present invention of sample No. 10 was more excellent than the comparative alloy of sample No. 15.

The structures of representative alloys of the present invention were observed. As a result, it was found that all the alloys had a structure having eutectic carbides and secondary carbides dispersed therein.

Figure 2:
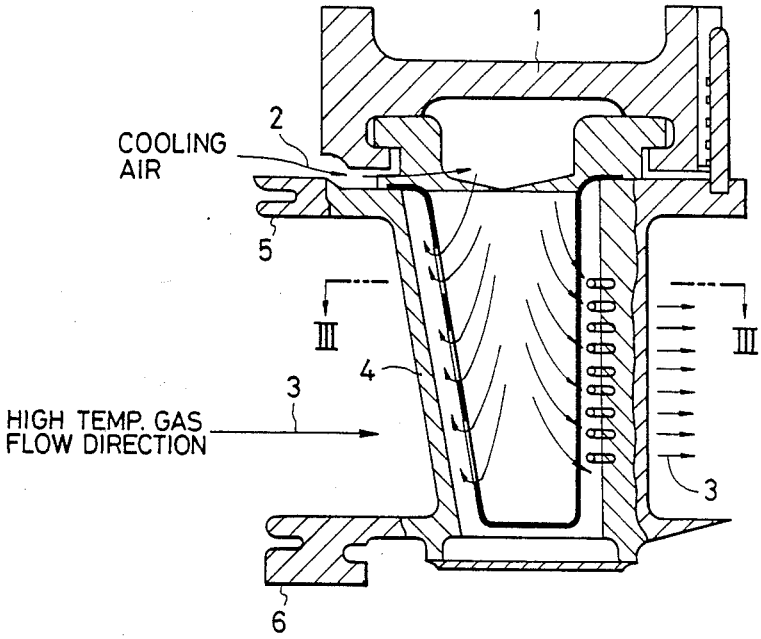
FIG. 2 is a cross-sectional view of a nozzle of a gas turbine according to the present invention.

FIG. 2 is a perspective view of one form of a nozzle segment of a gas turbine according to the present invention. Several segments of this kind are combined in the ring form to form the entire nozzle.

Figure 3:
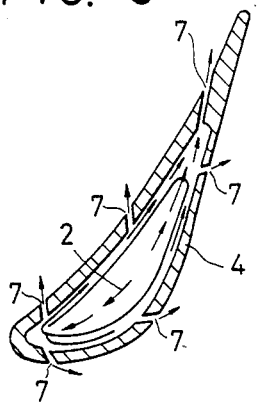
FIG. 3 is a cross-sectional view taken along the line III—III of FIG. 2.

FIG. 3 is a cross-sectional view taken along the line III—III of FIG. 2.

As shown in FIGS. 2, 3, the gas turbine nozzle has nozzle segments 4 each having thin wall portions forming a hollow portion and upper and lower shroud 5, 6 arranged at both ends of each of the nozzle segments 4 so as to keep the nozzle segments at a predetermined distance and in a predetermined direction. The nozzle segments 4 each have cooling-air holes 7 passing the thin wall portions from the hollow portion to the outside thereof. The cooling-air holes 7 are provided so that cooling-air 2 is jetted in a high-temperature gas flow 3 therethrough. The high-temperature gas flows from left to right in FIG. 3. The cooling-air holes 7 are provided in the nozzle segments 4 on the side on which the high-temperature gas contacts directly and on the opposite side at a predetermined distance so as to cover almost all the surface in three steps, whereby an air layer is formed on the nozzle surface and the nozzle surface is prevented from being directly exposed to the high-temperature gas.

The gas turbine nozzle is fixed at the outer peripheral portion by a retainer ring 1. The nozzle segment 4 has a wider width in the outer peripheral portion than in the inner peripheral portion, and the thickness including the hollow on the upstream side of the high-temperature gas flow 3 is larger than on the downstream side thereof. The thickness of walled portions constituting the hollow portion is substantially the same as each other. The nozzle segments of two or three are integrated but nozzle segment of one piece is preferable.

It is preferred that the nozzle segment according to the present invention be in the single form as mentioned above. With respect to the alloy of sample No. 5, a casting of a rod material (master ingot) was prepared by melting in vacuum ($10^{-3}$ torr) in the same manner as mentioned above. The ingot was again melted in vacuum ($10^{-3}$ torr) in the same manner as mentioned above, and a nozzle of a gas turbine as shown in FIG. 2 was produced therefrom by the lost wax process. Remelting was conducted so that the time for which the alloy is maintained in a molten state was as short as possible so as to prevent occurrence of variation of the component. The alloy was poured at a temperature by about 50° C. higher than the melting point of the alloy. The lost wax mold was heated at a high temperature, and casting was conducted in vacuum as mentioned above. The head and runner were cut off, and the resulting casting was heat-treated in the same manner as mentioned above. The heat treatment was conducted in a non-oxidizing atmosphere. After completion of the heat treatment, the casting was subjected to surface finishing by means of sandblast grinding, barrel grinding or the like. The nozzle of a gas turbine using the alloy of the present invention thus prepared was satisfactory and had no defect even at the tip of the nozzle comprising a thin-wall portion having a thickness of 0.8 mm.

The nozzle thus prepared was heat-treated in the same manner as mentioned above and applied to the test.

The nozzle segment according to the present invention was applied to a bench test with respect to repetition of starting and stopping under the same conditions as those of an actual gas turbine and exposure to a kerosine combustion gas for a long period of time. As a result, it was found that the alloy of the present invention exhibited an excellent fatigue resistance in repetition of starting and stopping as well as an excellent corrosion resistance when exposed to a high-temperature combustion gas and, therefore, the alloy of the present invention is expected to have a long service life.

As is apparent from the foregoing description, the cobalt-base alloy of the present invention is excellent in both high-temperature strength and toughness, and a satisfactory casting can be produced therefrom. It is apparent that the application of the alloy of the present invention to a nozzle of a gas turbine leads to a service life of the nozzle longer than that of the nozzle of a gas turbine which is produced from the conventional alloy and brings about excellent effects in a gas turbine.

What is claimed is:

1. A cobalt-base alloy having a high strength and a high toughness in the form of a casting, said alloy consisting essentially of 0.2 to 1% by weight of carboxy 0.4 to 2% by weight of silicon, 0.2 to 1.5% by weight of manganese, 5 to 15% by weight of nickel, 20 to 35% by weight of chromium, 3 to 15% by weight of tungsten, 0.003 to 0.1% by weight of boron, 0.05 to 1% by weight of niobium, 0.01 to 1% by weight of titanium, 2% by weight or lower of iron, 30 ppm or lower of oxygen and 100 ppm or lower of nitrogen with the balance being 45% by weight or higher of cobalt, wherein the content of the silicon is larger than a value of a silicon content (Si) obained from a manganese content (Mn) by the following equation: Si (wt %)=0.7×Mn (wt %)+0.48, and said alloy has a structure containing a eutectic carbide and a secondary carbide dispersed therein.

2. A cobalt-base alloy having a high strength and a high toughness according to claim 1, wherein said alloy consists essentially of 0.35 to 0.45% by weight of carbon, 0.4 to 1.00% weight of silicon, 0.2 to 0.6% by weight of manganese, 9.5 to 11.5% by weight of nickel, 28.5 to 30.5% by weight of chromium, 6.5 to 7.5% by weight of tungsten, 0.005 to 0.015% by weight of boron, 0.1 to 0.3% by weight of titanium, 0.15 to 0.35% by weight of niobium, 1.5% by weight or lower of iron, 25 ppm or lower of oxygen and 30 ppm or lower of nitrogen with the balance being cobalt.

3. A cobalt-base alloy having a high strength and a high toughness in the form of a casting, said alloy consisting essentially of 0.2 to 1% by weight of carbon, 0.4 to 2% weight of silicon, 0.2 to 1.5% by weight of manganese, 5 to 15% by weight of nickel, 20 to 35 % by weight of chromium, 3 to 15% by weight of tungsten, 0.003 to 0.1% by weight of boron, 0.05 to 1% by weight of niobium, 0.01 to 1% by weight of titanium, 0.02 to 0.5% by weight of zirconium, 2% by weight or lower of iron, 30 ppm or lower of oxygen and 100 ppm or lower of nitrogen with the balance being 45% by weight or higher of cobalt, wherein the content of silicon is larger than a value of a silicon content (Si) obtained from a manganese content (Mn) by the following equation: Si (wt %)=0.7×Mn (wt %)+0.48 and said alloy has a structure containing a eutectic carbide and a secondary carbide dispersed therein.

4. A cobalt-base alloy having a high strength and a high toughness according to claim 3, wherein said alloy consists essentially of 0.35 to 0.45% by weight of carbon, 0.4 to 1.00% by weight of silicon, 0.2 to 0.6% by weight of manganese, 9.5 to 11.5% by weight of nickel, 28.5 to 30.5% by weight of chromium, 6.5 to 7.5% by weight of tungsten, 0.005 to 0.015% by weight of boron, 0.1 to 0.3% by weight of titanium, 0.15 to 0.35% by weight of niobium, 0.1 to 0.3% by weight of zirconium, 0.5% by weight or lower of iron, 25 ppm or lower of oxygen and 30 ppm or lower of nitrogen with the balance being cobalt.

5. A cobalt-base alloy having a high strength and a high toughness in the form of a casting, said alloy consisting esentially of 0.2 to 1% by weight of carbon, 0.4 to 2% by weight of silicon, 0.2 to 1.5% by weight of manganese, 5 to 15% by weight of nickel, 20 to 35 % by weight of chromium, 3 to 15% by weight of tungsten, 0.003 to 0.1% by weight of boron, 0.05 to 1% by weight of niobium, 0.01 to 1% by weight of titanium, 2% by weight or lower of iron, at least one member selected from the group consisting of 0.01 to 0.5% by weight of rare earth elements and 0.01 to 0.5% by weight of yttrium, 30 ppm or lower of oxygen and 100 ppm or lower of nitrogen with the balance being 45% by weight or higher of cobalt, wherein the content of silicon is larger than a vlaue of a silicon content (Si) obtained from a manganese content (Mn) by the following equation: Si (wt %)=0.7×Mn (wt %)+0.48, and said alloy has a structure containing a eutectic carbide and a secondary carbide dispersed therein.

6. A cobalt-base alloy having a high strength and a high toughness according to claim 5, wherein said alloy consists essentially of 0.35 to 0.45% by weight of carbon, 0.4 to 1.00% by weight of silicon, 0.2 to 0.6% by weight of manganese, 9.5 to 11.5% by weight of nickel, 28.5 to 30.5% by weight of chromium, 6.5 to 7.5% by weight of tungsten, 0.005 to 0.0I5% by weight of boron, 0.1 to 0.3% by weight of titanium, 0.15 to 0.35% by weight of niobium, 0.1 to 0.3% by weight of zirconium, 0.5% by weight or lower of iron, at least one member selected from the group consisting of 0.03 to 0.15% by weight of rare earth elements and 0.003 to 0.15% by weight of yttrium, 25 ppm or lower of oxygen and 30 ppm or lower of nitrogen with the balance being cobalt.

7. A cobalt-base alloy having a high strength and a high toughness in the form of a casting, said alloy consisting essentially of 0.2 to 1% by weight of carbon, 0.4 to 2% by weight of silicon, 0.2 to 1.5% by weight of manganese, 5 to 15% by weight of nickel, 20 to 35 % by weight of chromium, 3 to 15% by weight of tungsten, 0.003 to 0.1% by weight of boron, 0.05 to 1% by weight of niobium, 0.01 to 1% by weight of titanium, 0.02 to 0.5% by weight of zirconium, 2% by weight or lower of iron, at least one member selected from the group consisting of 0.01 to 0.5% by weight of rare earth elements and 0.01 to 0.5% by weight of yttrium, 30 ppm or lower of oxygen and 100 ppm or lower of nitrogen with the balance being 45% by weight or higher of cobalt, wherein the content of the silicon is larger than a value of a silicon content (Si) obtained from a manganese content (Mn) by the following equation: (Si (wt %)=0.7×Mn (wt %)+0.48, and said alloy has a structure containing a eutectic carbide and a secondary carbide dispersed therein.

8. A cobalt-base alloy having a high strength and a high toughness according to claim 7, wherein said alloy consists essentially of 0.35 to 0.45% by weight of carbon, 0.4 to 1.00% by weight of silicon, 0.2 to 0.6% by weight of manganese. 9.5 to 11.5% by weight of nickel, 28.5 to 30.5% by weight of chromium, 6.5 to 7.5% by weight of tungsten, 0.005 to 0.015% by weight of boron, 0.1 to 0.3% by weight of titanium, 0.15 to 0.35% by weight of niobium, 0.1 to 0.3% by weight of zirconium, 0.5% by weight or lower of iron, at least one member selected from the group consisting of 0.03 to 0.15% by weight of rare earth elements and 0.003 to 0.15% by weight of yttrium, 25 ppm or lower of oxygen and 30 ppm or lower of nitrogen with the balance being cobalt.

9. A process for producing a cobalt-base alloy having a high strength and a high toughness in the form of a casting, said alloy consisting esentially of 0.2 to 1% by weight of carbon, 0.4 to 2% by weight of silicon, 0.2 to 1.5% by weight of manganese, 5 to 15% by weight of nickel, 20 to 35% by weight of chromium, 3 to 15% by weight of tungsten, 0.003 to 0.1% by weight of boron, 0.05 to 1% by weight of niobium, 0.01 to 1% by weight of titanium, 0.02 to 0.5% by weight of zirconium, 2% by weight or less of iron, 30 ppm or lower of oxygen and 100 ppm or less of nitrogen with the balance being 45% by weight or higher of cobalt, wherein the content of the silicon is larger than a value of a silicon content (Si) obtained from a manganese content (Mn) by the following equation: Si (wt %)=0.7×Mn (wt %)+0.48, and said alloy has a structure containing a eutectic carbide and a secondary carbide dispersed therein, said process comprising the steps of:

producing a casting through vacuum melting of said alloy;

heating said casting to a temperature of 1,100° to 1,200° C. and keeping said casting at said temeperature thereby efecting solution treatment;

cooling said casting from said temperature of solution treatment to an aging temperature of 950° to 1,050° C. through furnace cooling or air cooling; and keeping said casting at said aging temperature thereby effecting aging treatment;

wherein said casting is cooled at a cooling rate of 150° to 300° C./h both after said solution treatment and after said aging treatment.

10. A nozzle for a gas turbine, which nozzle comprises nozzle segments each having thin wall portions forming a hollow portion therein, and upper and lower shrouds provided at both ends of said nozzle segments so as to arrange said nozzle segments in a direction and at a distance therebetween, said nozzle segments each having cooling air holes passing through said thin wall portions from said hollow portion into the outside thereof, and which nozzle is made of a casting, said alloy consisting esentially of:

0.2 to 1% by weight of carbon, 0.4 to 2% by weight of silicon, 0.2 to 1.5% by weight of manganese, 5 to 15% by weight of nickel, 20 to 35% by weight of chromium, 3 to 15% by weight of tungsten, 0.003 to 0.1% by weight of boron, 0.05 to 1% by weight of niobium, 0.01 to 1% by weight of titanium, 2% by weight or less of iron, 30 ppm or less of oxygen and 100 ppm or less of nitrogen with the balance being 45% by weight or more of cobalt, wherein the content of silicon is larger than a value of a silicon content (Si) obtained from a manganese content (Mn) by the following equation: Si (wt %)=0.7×Mn (wt %)+0.48, said casting having a structure containing a eutectic carbide and a secondary carbide dispersed therein.

11. A nozzle for a gas turbine, which nozzle comprises nozzle segments each having thin wall portions forming a hollow portion therein, and upper and lower shrouds provided at both ends of said nozzle segments so as to arrange said nozzle segments in a direction and at a distance therebetween, said nozzle segments each having cooling air holes passing through said thin wall portions from said hollow portion into the outside thereof, and which nozzle is made of a casting, said alloy consisting essentially of:

0.2 to 1% by weight of cargbon, 0.4 to 2% by weight of silicon, 0.2 to 1.5% by weight of manganese, 5 to 15% by weight of nickel, 20 to 35% by weight of chromium, 3 to 15% by weight of tungsten, 0.003 to 0.1% by weight of boron, 0.05 to 1% by weight of niobium, 0.01 to 1% by weight of titanium, 2% by weight or less of iron, 30 ppm or less of oxygen and 100 ppm or less of nitrogen with the balance being 45% by weight or more of cobalt, at least one element selected from the group consisting of 0.02 to 0.5 wt % of Zr, 0.01 to 0.5 wt % of rare earth metal and 0.01 to 0.5 wt % of Y, wherein the content of silicon is larger than a value of a silicon content (Si) obtained from a manganese content (Mn) by the following equation: Si (wt %)=0.7×Mn (wt %)+0.48, said casting having a structure containing a eutectic carbide and a secondary carbide dispersed therein.

* * * * *